United States Patent [19]

Reynolds

[11] Patent Number: 5,062,814

[45] Date of Patent: Nov. 5, 1991

[54] OUTBOARD MOTOR

[75] Inventor: George Reynolds, Surrey, Canada

[73] Assignee: Ronald F. Taylor, Richmond, Canada

[21] Appl. No.: 379,578

[22] Filed: Jul. 12, 1989

[51] Int. Cl.[5] ..... B63H 16/20

[52] U.S. Cl. ..... 440/31; 440/76

[58] Field of Search ..... 440/21, 26, 28, 31, 440/75, 76, 98, 900, 53; 74/DIG. 10; 114/162

[56] References Cited

U.S. PATENT DOCUMENTS

| | | | |
|---|---|---|---|
| 1,843,823 | 2/1932 | Kohn | 440/31 |
| 2,329,574 | 9/1943 | Allen | 440/26 |
| 2,627,243 | 2/1953 | Stahmer | 440/28 |
| 2,684,045 | 7/1954 | Cato | 440/31 |
| 3,153,397 | 10/1964 | Mattson et al. | 440/76 |
| 3,174,357 | 3/1965 | Conklin | 440/53 |
| 3,323,482 | 6/1967 | Sawborn | 440/31 |
| 4,616,164 | 10/1986 | Kenny et al. | 74/DIG. 10 |

OTHER PUBLICATIONS

Delrin Acetal Resins, Dupont Poly Chemicals Dept. Wilmington, Del., Oct. 1959.

*Primary Examiner*—Jesus D. Sotelo
*Assistant Examiner*—Stephen P. Avila
*Attorney, Agent, or Firm*—John Russell Uren

[57] ABSTRACT

A manually operated outboard motor. A propeller is connected to a first shaft which is geared through plastic mitre gears to a further shaft. The further shaft is connected to a gear which, in turn, is driven by a gear connected to a crank extending from the top of the housing of the outboard motor. The crank includes a handle and the crank and handle are manually rotated which, in turn, rotates the propeller.

6 Claims, 4 Drawing Sheets

OUTBOARD MOTOR

INTRODUCTION

This invention relates to an outboard motor and, more particularly, to a manually operated outboard motor.

BACKGROUND OF THE INVENTION

Outboard motors powered by a source of energy other than that provided by the human body are, of course, known and in wide use. They use a variety of configurations and are generally attached to the transom of a boat to power the boat when desired. They operate well for the purposes with which they are intended.

Such powered outboard motors, however, are not applicable or suitable for many purposes. For example, some motors may not run well at low speeds when trolling for fish is desired. Likewise, such outboard motors are not suitable when quiet operation is desired such as in duck or bird hunting on water. Likewise, the use of powered outboard motors for young children is inherently dangerous due to the rotating propeller and the power of the motor which may be inadvertently used and which might create problems relating to the handling of the vessel to which the motor is attached. For many operations, the cost of the powered outboard motor is high and it is a desirable objective to obtain the benefits of an outboard motor used for such purposes with the reduced expenditure required. Finally, powered outboard motors are heavy and are not readily transportable. Likewise, because they are heavy, they sink if they become detached from the transom and no safety device is present which retains a connection between the motor and the boat.

SUMMARY OF THE INVENTION

According to one aspect of the invention, there is provided a manually operated outboard motor comprising an upper housing and a lower skeg operably connected to said upper housing a propeller operably mounted in said lower skeg portion, a plurality of shaft means extending between said propeller and said upper housing, gear means between said plurality of shaft means, a crank rotatable in said upper housing and being operably connected to one of said gear means, said crank having a handle operatively attached thereto, said crank and handle being manually rotated and operating to power said plurality of shaft means and said propeller.

BRIEF DESCRIPTION OF THE SEVERAL VIEWS OF THE DRAWINGS

An embodiment of the invention will now be described, by way of example only, with the use of drawings in which.

DESCRIPTION OF SPECIFIC EMBODIMENT

Figure 1:
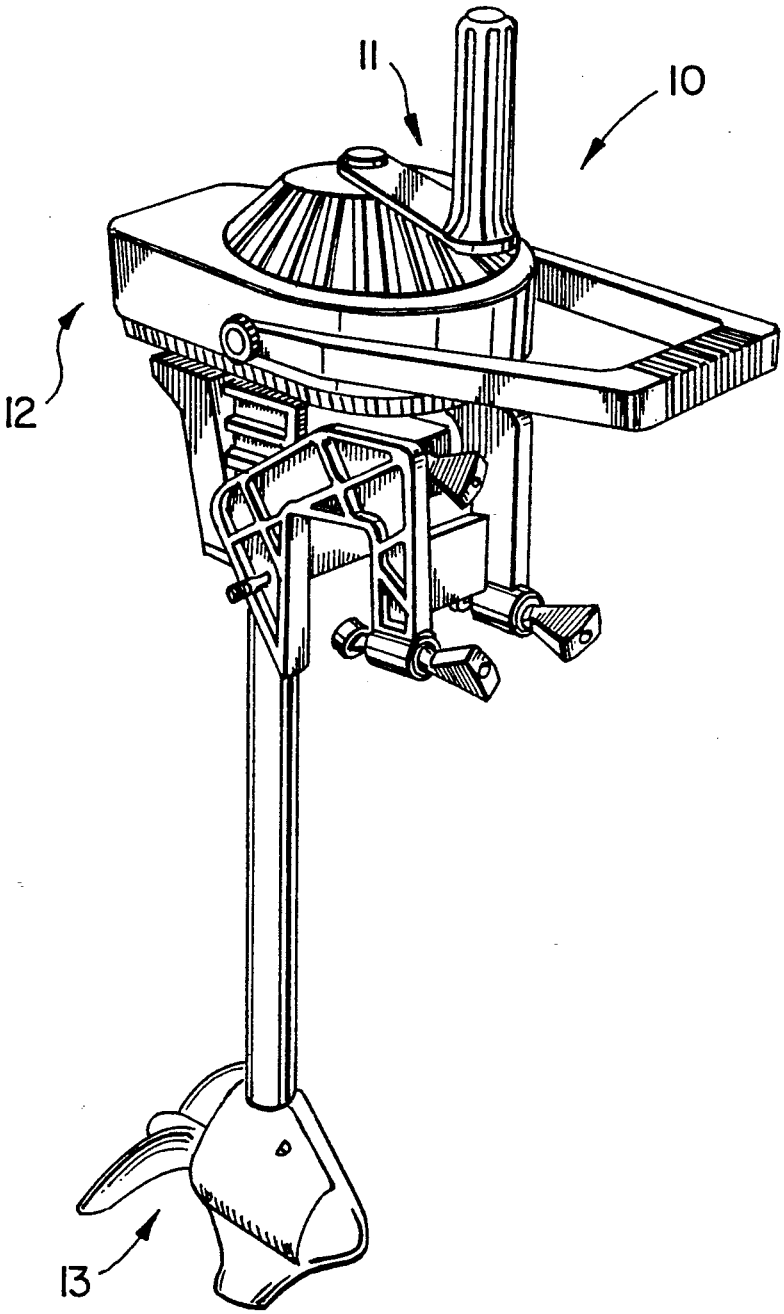
FIG. 1 is an isometric view of the outboard motor according to the invention.

Reference is now made to the drawings and, in particular to FIG. 1 where an outboard motor according to the invention is generally illustrated at 10. It comprises a crank and handle portion generally shown at 11, an upper housing portion generally illustrated at 12, and a lower skeg and propeller portion generally illustrated at 13.

Figure 2A:
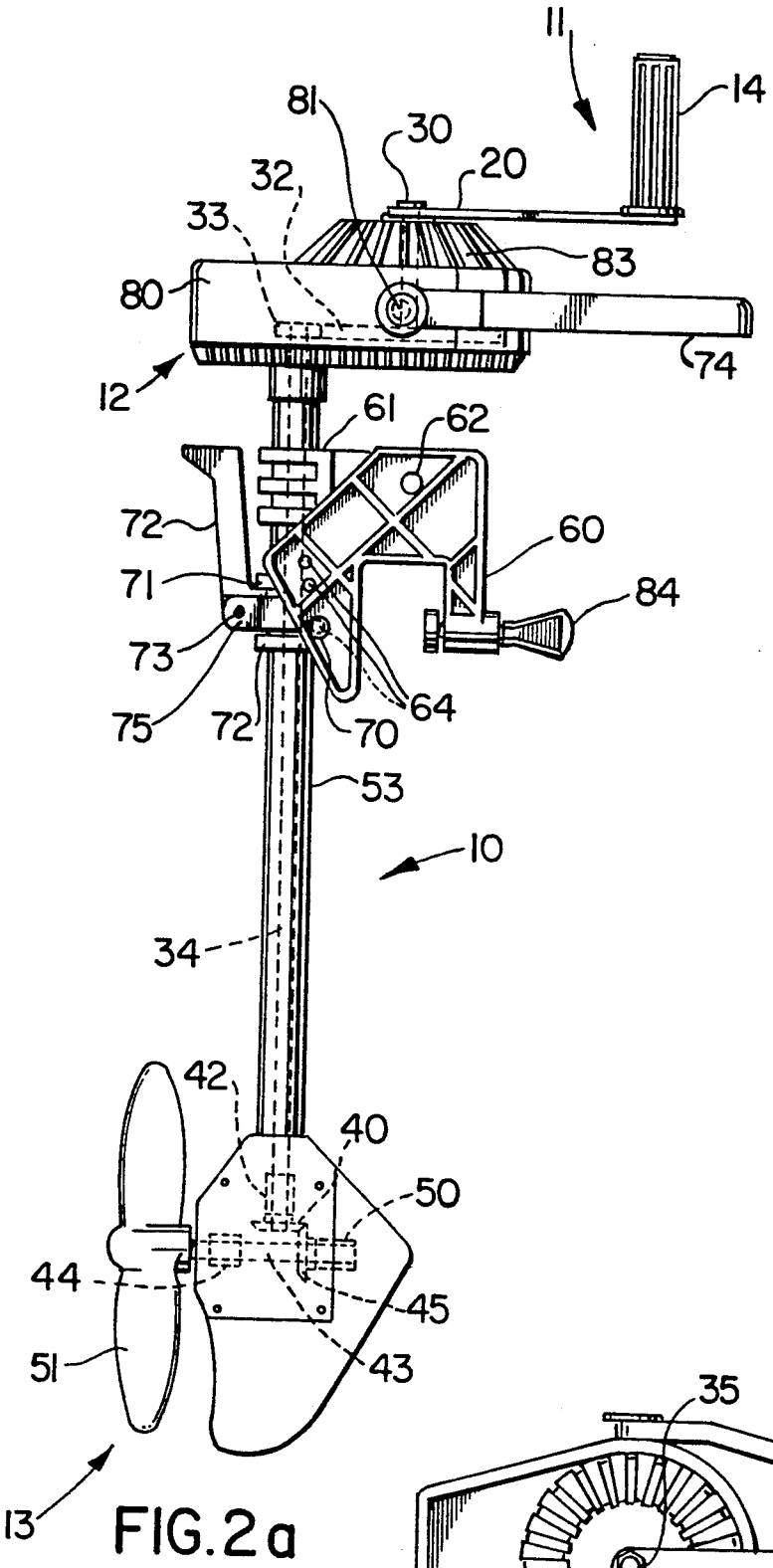
FIGS. 2*a*, 2*b* and 2*c* are diagrammatic side, plan and front views of the outboard motor illustrating some portions of the operating mechanisms according to the invention.
Figure 4B:
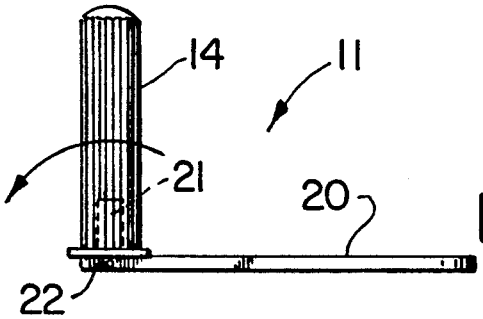
FIGS. 4*a* and 4*b* are bottom and side views of the crank and handle mechanisms.
Figure 4A:
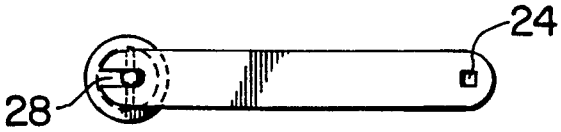

With reference to FIG. 2*a*, the crank and handle portion 11 includes a handle 14 and a crank 20 to which the handle 14 is rotatably mounted as also seen in FIGS. 4*a* and 4*b*. The handle 14 is rotatably mounted on a shaft 21 which is directly mounted to the crank 20 by a pin 22 which is inserted through the crank 20 and the shaft 21 and which allows the handle 14 to rotate about the axis of the pin 22 and through a recess 23 on the crank 20 (FIG. 4*a*) as indicated by the arrows. Handle 14 is spring mounted on shaft 21 which allows the handle to move axially with respect to shaft 21 and which allows the handle 14 to rotate through 180 degrees as indicated in FIG. 4*b* and thereby assume a position opposite to that indicated.

Figure 2B:
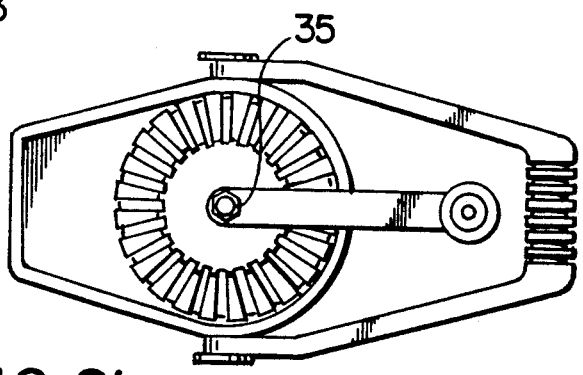
Figure 2C:
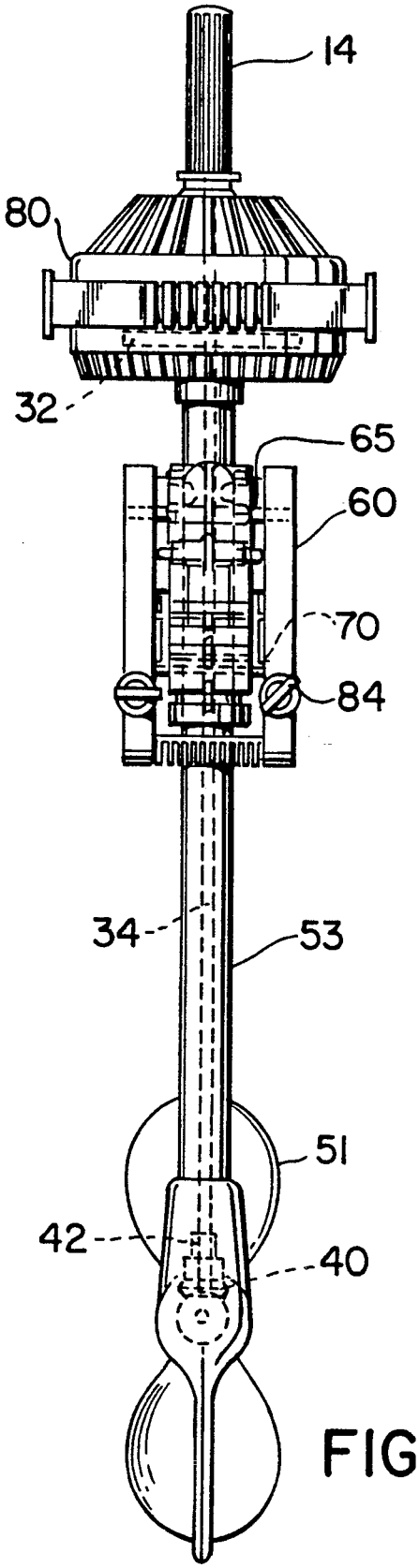

A rectangular recess 24 is also located in the crank 20 and allows the crank 20 to be connected to an extension 30 (FIG. 2*a*) which extends from the end of upper shaft 31 and which fits within the rectangular recess 24. The extension 30 is threaded and a nut 35 (FIG. 2*b*) is connected over the top of crank 20 after the crank 20 is mounted on the extension 30.

Figure 3B:
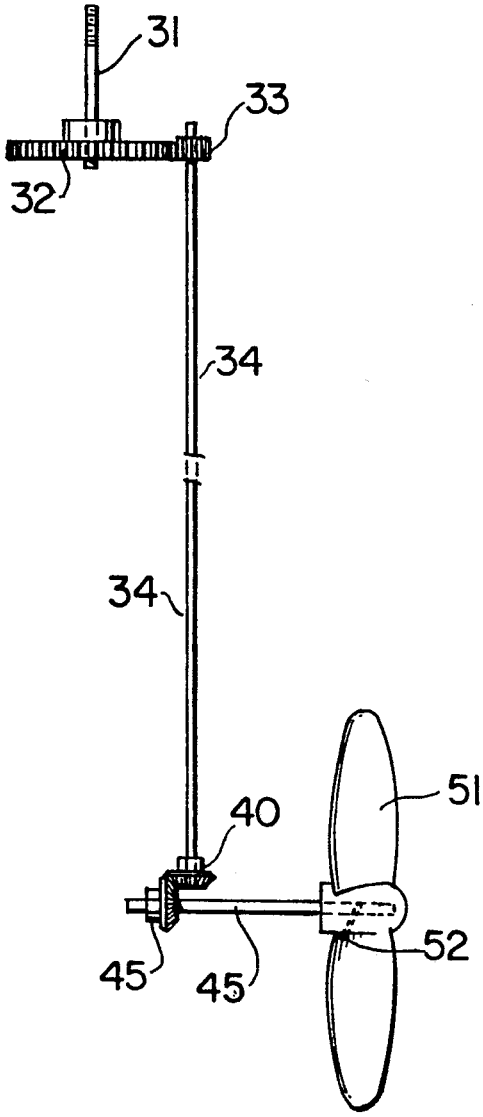
FIGS. 3*a* and 3*b* are diagrammatic side and front views of the operating shafting arrangements according to the invention.
Figure 3A:
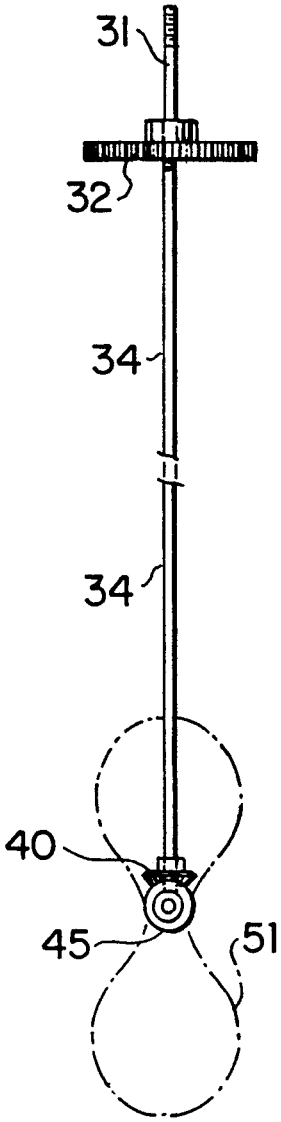

Reference is now made to FIGS. 3*a* and 3*b* which illustrate the shafting used in the outboard motor 10.

Upper shaft 31 extends from the threaded portion on which is mounted the crank 20 to the main gear 32 which is mounted to the upper shaft 31 by way of a key (not shown) extending between the shaft 31 and the main gear 32. Main gear 32 is made from DELRIN (Trademark) material and mates with a spur gear 33 also made from DELRIN material which is mounted with a keyed connection to the transom shaft 34. There is a ration of 80:13 between the main gear 32 and the spur gear 33.

Transom shaft 34 extends between spur gear 33 and a lower mitre gear 40 mounted in the lower skeg and propeller portion 13 of the outboard motor 10. Transom shaft 34 is mounted in an upper and lower bushing 41, 42, respectively. (FIG. 2*a*).

A further mitre gear 45 mates with mitre gear 40. Mitre gear 45 is connected to a skeg or propeller shaft 43 which extends between bushings 44, 50 (FIG. 2*a*). The mitre gears 40, 45 are made form DELRIN plastic material. A propeller 51 is mounted on the end of skeg shaft 43 by a soft aluminum shear pin 52. A retaining pin (not shown) holds the propeller 51 on the skeg shaft 43 in the event the retaining shear pin 52 becomes sheared off.

A main shaft housing 53 extends between the upper housing portion 12 and the lower skeg and propeller portion 13. A transom mount 60 is pivotally mounted to bracket 61 which is rigidly mounted to the transom or main shaft housing 53. Transom mount 60 pivots about axis 62 which comprises a pin 63 extending between the two sides of the transom mount 60.

Transom mount 60 further includes a plurality of holes 64 and a set of two adjustable clamps 84. A pin 70 is mounted so as to extend between the two sides of the transom mount 60. The pin 70 is operatively adapted to contact a complementary mating portion 71 rotatably mounted on a bracket 75 which is rigidly connected to the main shaft housing 53. Pin 70 may be positioned in one of the four different sets of holes 64 and, thus, the motor 10 is able to be operatively positioned at one of a plurality of predetermined angles relative to the transom mount 60.

The mating portion 71 is connected to a spring loaded release bar 72. The bar 72 is rotatably mounted about axis 73 and, when moved in the direction indicated, the mating portion 71 will move out of engagement with pin 70 extending between the two sides of the transom mount 60, thereby allowing the lower skeg and propeller portion 13 of the outboard motor 10 to be moved clockwise and out of the water about axis 62.

A steering handle 74 is rotatably mounted on the housing 80 of the outboard motor 10. Handle 74 rotates about axis 81 and may be moved 180 degrees to assume a position directly opposite to the location as seen in FIG. *2a*. A stop portion 82 mounted on the housing 80 maintains the steering handle 74 in its horizontal position as seen in FIG. *2a* but does not interfere with the steering handle 74 when it is rotated to its opposite or storage position.

A foam material 83 is located within the housing 80 of the outboard motor 10. The purpose of the foam material 83 is to allow the outboard motor 10 to float if it is dropped into the water. Since the motor 10 weighs about eight pounds, the amount of foam material required to keep the motor 10 from sinking is not substantial.

OPERATION

In operation, it will be assumed that the outboard motor 10 is stored and is not mounted on the transom of a boat. In this case, the steering handle 74 will be in a position 180 degrees opposite to that location illustrated in FIG. *2a* and the crank 20 will be similarly located with the spring loaded handle 14 being directed downwardly and assuming a position located between the two sides of the steering handle 74.

Likewise, the mating portion 71 of the spring loaded release bar 72 will be out of contact with pin 70 and the transom mount 60 will be 90 degrees removed counterclockwise from the position illustrated in FIG. *2a* relative to the housing 80 of the outboard motor 10.

The user will fit the transom mount 60 over the transom of the boat (not shown) and tighten the clamps 84 of the transom mount 60 such that the motor 10 is securely mounted to the transom. The release bar 72 will then be rotated clockwise about axis 73 and the outboard motor 10 will be rotated about axis 62 until the mating portion 71 reaches a position to pass freely over the pin 70 extending between the holes 64 in the transom mount 60 as the motor 10 is rotated counter clockwise relative to the transom mount 60 and the lower skeg and propellor portion 13 are lowered into the water. The outboard motor 10 will then be angularly adjusted using the pin 70 and mating portion 71 until the desired position is reached whereupon the release bar 72 is released and the mating portion 71 of the release bar 72 contacts the pin 70 which passes through opposite sides of the transom mount 60.

The handle 14 will be rotated about the axis of pin 22 for 180 degrees until it faces upwardly as seen in FIG. *4b* and the steering handle 74 will further be rotated until it reaches the position illustrated in FIG. *2a*. The motor 10 is then ready for operation.

The operation is straightforward. The user will grasp the handle 14 of the motor 10 and rotate the crank 20. Crank 20, being connected to upper shaft 31, will rotate that shaft 31 and the attached main gear 32. Main gear 32 will rotate spur gear 33 with reference to FIG. *3b* and spur gear 33 will rotate main shaft 34 and lower mitre gears 40, 45 which, in turn, will rotate propellor or skeg shaft 43. Skeg shaft 43 will rotate the propellor 51 and the boat will be powered either forwardly or rearwardly depending on the direction the crank 20 is rotated.

A specific embodiment of the invention has been described and it is clear many modifications may be made. For example, it is contemplated that the vertical handle 14 may be replaced with a knob which would allow the palm of the hand of the user to be maintained in a substantially horizontal position while the crank 20 is being rotated rather than the vertical position now dictated by the shape of the handle 14. Likewise, it is contemplated that the two bladed propellor 51 illustrated in the drawings may be replaced with a three bladed propellor depending on the application to which the motor 10 is intended.

While the embodiment disclosed has been specifically described, such description is for the purpose of illustration only and should not be taken as limiting the scope of the invention as construed in accordance with the accompanying claims.

What is claimed is:

1. A manually operated outboard motor which is removably attachable to a boat comprising an upper housing and a lower skeg portion operably connected to said upper housing, a propeller operably mounted in said lower skeg portion, a plurality of shaft means extending between said propeller and said upper housing, gear means between said plurality of shaft means, a crank rotatable about a vertical axis in said upper housing and being operably connected to said plurality of shaft means, said crank having a handle operatively attached thereto, said crank and crank handle being manually rotated and operating to power said plurality of shaft means and said propellor and including steering means, separate from the crank, for changing the orientation of the propellor relative to said boat for steering said boat, said steering means further being operable to be moved to positions forwardly or rearwardly of said housing independently of the movement of said lower skeg portion and comprising a handle which is capable of pivotal movement relative to the housing about a substantially horizontal axis extending through said upper housing.

2. A manually operated outboard motor, as in claim 1, wherein said crank and crank handle can be operated in either direction of rotation to rotate said propellor both forwardly and in reverse.

3. A manually operated outboard motor as in claim 2 and further comprising foam in said upper housing, said foam being operable to allow said motor to float.

4. A manually operated outboard motor as in claim 1, wherein the crank handle is movable between an upwardly projecting operative position and a downwardly projecting storage position.

5. A manually operated outboard motor as in claim 1, wherein said plurality of shaft means comprises vertical and horizontal shaft means, said gear means being provided between said vertical and horizontal shaft means.

6. A manually operated outboard motor as in claim 5, wherein said vertical rotation axis of the crank is offset from said vertical shaft means.

* * * * *